US006799609B2

(12) United States Patent
Scorl et al.

(10) Patent No.: US 6,799,609 B2
(45) Date of Patent: Oct. 5, 2004

(54) SLEY APPARATUS

(75) Inventors: Hans-Dieter Scorl, Ruti (CH); Heinz Baumann, Seuzach (CH)

(73) Assignee: Sultex AG, Rueti (CH)

( * ) Notice: Subject to any disclaimer, the term of this patent is extended or adjusted under 35 U.S.C. 154(b) by 40 days.

(21) Appl. No.: 10/198,921

(22) Filed: Jul. 18, 2002

(65) Prior Publication Data

US 2004/0011416 A1 Jan. 22, 2004

(30) Foreign Application Priority Data

Jul. 23, 2001 (EP) ..... 01810728

(51) Int. Cl.[7] ..... D03D 49/60
(52) U.S. Cl. ..... 139/188 R
(58) Field of Search ..... 139/188 R, 189, 139/190, 191, 192

(56) References Cited

U.S. PATENT DOCUMENTS 3,565,126 A * 2/1971 Schlappi ..... 139/341
3,667,306 A 6/1972 Atkinson
3,978,898 A * 9/1976 Juillard ..... 139/449
4,060,104 A * 11/1977 Steverlynck ..... 139/186 R
4,936,353 A * 6/1990 Volland et al. ..... 139/194
4,962,795 A 10/1990 Haeussler et al.

FOREIGN PATENT DOCUMENTS

| | | |
|---|---|---|
| BE | 439949 A | 12/1940 |
| BE | 704022 A | 2/1968 |
| EP | 0342135 A1 | 11/1989 |
| JP | 09228193 | 9/1997 |
| JP | 2001032148 | 2/2001 |

* cited by examiner

*Primary Examiner*—Danny Worrell
(74) *Attorney, Agent, or Firm*—Townsend and Townsend and Crew LLP

(57) ABSTRACT

A sley apparatus for a weaving machine which has a sley profile (1), a reed (2) and a drive (3), with the sley profile (1) carrying the reed (2) and being in active connection with the drive (3). The sley profile (1) has at least two separate parts, namely a main profile part (4) and an auxiliary profile part (5), with the auxiliary profile part (5) being releasably connected directly or indirectly to the main profile part (4).

12 Claims, 4 Drawing Sheets

SLEY APPARATUS

BACKGROUND OF THE INVENTION

The invention relates to a sley apparatus having a sley profile, a reed, and a drive. The sley profile carries the reed and is in active connection with the drive.

Jet weaving machines are characterized in particular in that the insertion of a weft thread into a shed is accomplished with the help of a flowing fluid, such as e.g. in air jet weaving machines with the help of compressed air. In a jet weaving machine of this kind a sley apparatus comprises a sley profile, a reed and a drive, with the sley profile carrying the reed and at least one apparatus which is designated as the main nozzle, and with the sley profile being in active connection with the drive. In this the weft thread is drawn off from a thread supply, which can for example be designed in the form of a drum storage, and accelerated for insertion into the shed by means of the main nozzle, which is fed by the flowing fluid. Additional air nozzles, so-called relay nozzles, which assist the progressing insertion of the weft thread into the shed, are provided at specific spacings along the weft insertion length on the sley profile. In this the main nozzle is in a rotationally fixed connection with the sley profile in order that the progressing weft insertion along the relay nozzles through the shed is not impaired by the pendulum-like movement of the sley apparatus. As a rule, the weft thread is held taut after its arrival until the shed is closed.

Under certain circumstances it proves advantageous to use a so-called tandem nozzle for the weft insertion in addition to the above-mentioned main nozzle. The tandem nozzle is placed in series ahead of the main nozzle. This arrangement corresponds substantially to two main nozzles which are placed one after the other with the purpose of achieving the introduction of the force for the thread transport via an increase of the thread surface on which the air acts. In this the tandem nozzle mainly takes over the unwinding of the weft thread from the drum storage, through which the unwinding resistance is compensated. Through this the pressure at the main nozzle can be diminished, which results in a more careful insertion of the web.

On the other hand, with a constant or higher pressure level of the main nozzle, the weft insertion speed or weft insertion time respectively can be varied in such a manner that depending on the weft material to be inserted and the weft thread length, i.e. the cloth draw-in width, a maximum weft-meter performance can be realized with the highest demands on the cloth quality.

Essentially two variants are known for the re-equipping of the sley profile from one main nozzle to a combination of a main nozzle with an additional tandem nozzle as a pre-nozzle. Either the tandem nozzle is fixedly connected to the frame of the weaving machine in a stationary manner by means of a holder section, or in this case the main nozzle is moved relative to the tandem nozzle during the weaving process. However, undesirable thread deflection points necessarily result with corresponding friction and the accompanying effects. In addition to this a second variant with a longer sley profile permits the reception of the main nozzle and the tandem nozzle. In this case there results a massive problem during the change back to only one main nozzle. Then, namely, in operation without the tandem nozzle, an additional unnecessary mass of the unused section of the sley profile must be co-moved, which can become highly problematical in particular at higher speeds of rotation of the machine.

The prior art for the arrangement of the main nozzle and the tandem nozzle on the sley profile will be explained in more detail in the following with reference to FIGS. 1 to 3 on the basis of several examples. To distinguish the prior art from the sley apparatus in accordance with the invention, the reference symbols in FIGS. 1 to 3 are provided with primes.

FIG. 1 shows a tandem nozzle 8', which is connected stationarily to a holder profile part 5'. In this the holder profile part 5' is in turn firmly connected to the frame 5" of the weaving machine. Since the sley profile 1' with the reed 2' and the main nozzle 6' carries out pendulum movements about the axis of the drive shaft 3' in operation, for the purpose of beating up the weft thread, there necessarily result undesirable thread deflection points with the corresponding friction necessarily resulting between the stationary tandem nozzle 8' and the main nozzle 6', which is moved with the sley. This leads to the known negative accompanying phenomena such as the production of additional frictional heat and to increased mechanical tensions in the thread, which fluctuate strongly in magnitude. As a result the advantages, such as for example the reduction of the weft insertion time, i.e. increase in the weft insertion speed, which are achieved through the use of the tandem nozzle as a relieving pre-nozzle, are at least partly compensated again. In certain cases the negative accompanying phenomena as a result of the additional thread deflection points between the tandem nozzle and the main nozzle are so severe that in sum total the stresses on the weft thread even increase and therefore the use of a tandem nozzle as a pre-nozzle in a stationary arrangement cannot be allowed.

To avoid undesirable thread deflection points between the tandem nozzle 8' and the main nozzle 6' the pre-nozzle can likewise be mounted on the sley profile 1' in accordance with FIG. 2. Then however the sley profile must be made longer. Admittedly additional thread deflection points between the tandem nozzle 8' and the main nozzle 6' are thereby avoided, because the tandem nozzle 8' is now co-moved synchronously in rotationally fixed connection with the main nozzle 6'.

However, a massive problem results here in the change back to only one main nozzle 6', or when the cloth width is to be reduced to such an extent that enough room for the positioning of the tandem nozzle 8' and the main nozzle 6' would be available on the sley profile 1' even without the use of a longer sley profile 1'. A situation of this kind is shown in an exemplary manner in FIG. 3, with it naturally being possible for the tandem nozzle 8' to be absent. Here the problem arises that undesirable additional masses must be co-moved. Enormous acceleration forces thereby arise through the pendulum-like movement of the sley profile during the weaving process which, if they are not to exceed certain limits, can make a reduction of the speed of rotation of the motor compulsory and/or can lead to the premature abrasion of corresponding machine components as a result of the additionally arising forces, for example in the form of bearing forces. Thus on the one hand the weft insertion performance is reduced and on the other hand maintenance intervals are shortened and the lifetime of mechanically stressed machine components is significantly reduced, through which the economical operation of the weaving machine is at least impaired. Moreover, additional thread guiding elements 9' must be used on removal of the pre-nozzle from the unshortened sley profile for the guidance of the weft thread in order to prevent a collision of the weft thread with the sley profile (see FIG. 3). Additional thread deflection points with the corresponding negative frictional effects thereby arise.

SUMMARY OF THE INVENTION

It is therefore an object of the invention to propose an improved sley apparatus for weaving machines which permits alternatively the ideal use either of one main nozzle alone or of a main nozzle in combination with a further tandem nozzle which is executed as a pre-nozzle. The problems which are known from the prior art should be avoided in order to arrive at a solution which is on the whole technically and economically more advantageous.

In the sley apparatus satisfying this object the sley profile has at least two separate parts, namely a main profile part and an auxiliary profile part, with the auxiliary profile part being releasably connected directly or indirectly to the main profile part. A main nozzle is arranged on the main profile part, and a tandem nozzle is arranged on the auxiliary profile part.

The sley apparatus for a weaving machine in accordance with the invention has a sley profile, a reed and a drive, with the sley profile carrying the reed and being in active connection with the drive. In this the sley profile comprises at least two separate parts, namely a main profile part and an auxiliary profile part, with the auxiliary profile part being releasably connected directly or indirectly to the main profile part.

The step from the single nozzle variant to the combination of a main nozzle with a tandem nozzle as a pre-nozzle takes place in accordance with requirements, for example when, as a result of a greater cloth width or when caused by a specific yarn sort, only insufficient compressed air power can be supplied for an unobjectionable weft insertion at a given speed of rotation of the machine. In particular in the processing of weak yarns only a limited pressure level is possible, for which reason two nozzles which are placed one after the other are not only advantageous, but also necessary, for a careful loading of the yarn.

The sley apparatus in accordance with the invention eliminates the above-described disadvantages of the present prior art in that the sley profile comprises two separate parts, namely a main profile part and an auxiliary profile part which are directly or indirectly releasably connected to one another. Thus on the one hand through mounting the auxiliary profile part at the sley apparatus and through producing a direct or indirect rotationally fixed connection between the main profile part and the sley profile part it can be ensured that during the weaving process the main nozzle and the tandem nozzle are at rest relative to one another and undesirable thread deflection points can be avoided. On the other hand, when the tandem nozzle is not required in a given operating mode, not only the tandem nozzle but also the auxiliary profile part which carries it can be removed, so that no unnecessary masses of an unused region of the sley profile need be co-moved.

In the following the invention will be explained with reference to exemplary embodiments and with reference to the drawings.

FIGS. 1 to 3 show the prior art. To distinguish the prior art from the sley apparatus in accordance with the invention, the reference symbols in FIGS. 1 to 3 are provided with primes. dr

DESCRIPTION OF THE PREFERRED EMBODIMENTS

The invention will be described in the following with reference to a preferred exemplary embodiment, in which a tandem nozzle, having the function of a pre-nozzle, and a main nozzle are provided. Moreover, the invention will be explained in more detail with reference to further advantageous variants of preferred embodiments.

Figure 4:
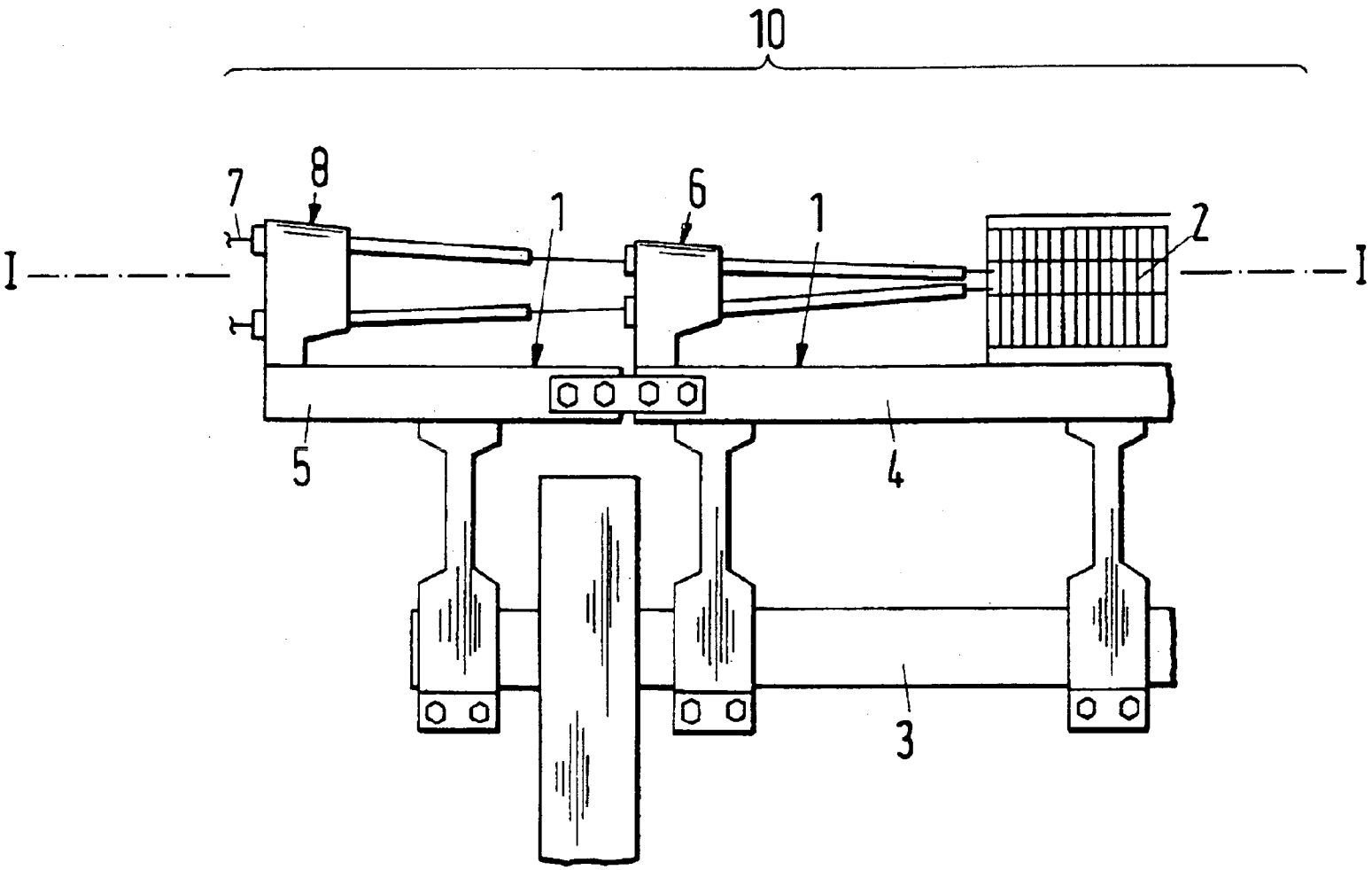
FIG. 4 shows an embodiment of a sley apparatus in accordance with the invention with a tandem nozzle and a main nozzle.

FIG. 4 shows in a schematic illustration an embodiment of a sley apparatus 10 in accordance with the invention. The sley profile 1, which is shown in an exemplary manner, comprises a main profile part or section 4, which is rotationally fixedly connected to the drive 3 and which carries both the main nozzle 6, which serves for the acceleration of a weft thread 7 by means of a fluid, and a reed 2 and an auxiliary profile part or section 5, which is in direct rotationally fixed connection both with a drive 3 and with the main profile part 4. In this the auxiliary profile part 5 need not necessarily be in direct connection with the main profile part 4 and the drive 3 at the same time.

In FIG. 4 for example the auxiliary profile part 5 is screwed directly onto the main profile part 4. Obviously other forms of the connection are also suitable.

The preferred exemplary embodiment which is schematically illustrated in FIG. 4 shows an arrangement, which is typical in practice, comprising a tandem nozzle and a main nozzle, such as are used in jet weaving machines, preferably in air jet weaving machines. In this the preferred exemplary embodiment shown does however not relate exclusively to jet weaving machines, which use a gaseous medium as a fluid for the acceleration of the weft thread. Liquid media, such as for example water, can also be considered as the fluid.

Figure 1:
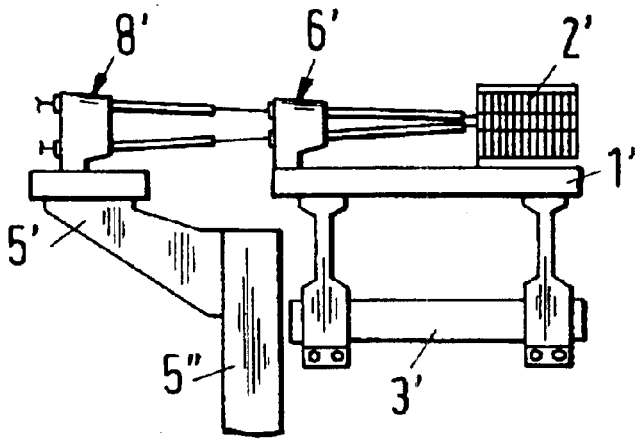
FIG. 1 shows a known embodiment for an arrangement of a combination of a stationary tandem nozzle and a main nozzle.
Figure 2:
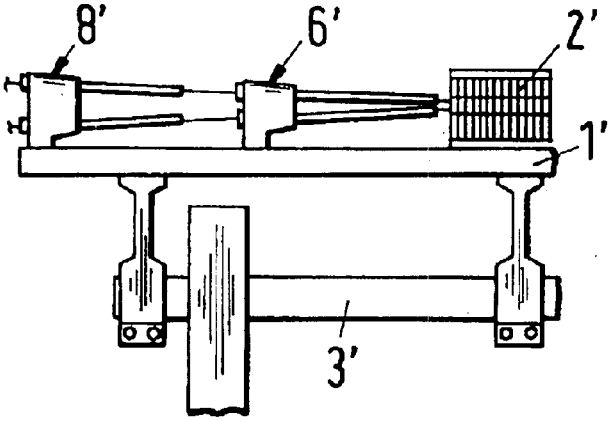
FIG. 2 shows a known embodiment for an arrangement of a tandem nozzle and a main nozzle on a sley profile which is made longer.
Figure 3:
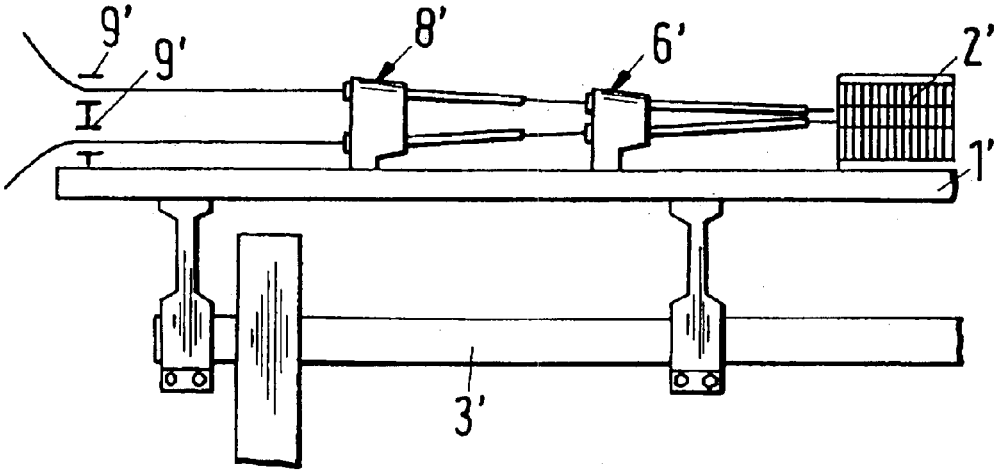
FIG. 3 shows as in FIG. 2, a region of the sley profile which is made longer remaining unused.

If the entire cloth width which is available is to be exploited, the tandem nozzle 8, which operates relievingly as a pre-nozzle, can no longer be arranged in addition to the main nozzle 6 on the main profile part 4 for reasons of space. In contrast with the prior art, which provides as a solution either a stationary mounting of the required tandem nozzle 8' (see FIG. 1) or a non-divisible sley profile 1' which is designed to be longer, as shown in FIG. 2, the tandem nozzle 8 is mounted on a separate auxiliary profile part 5 in the sley apparatus in accordance with the invention. The particular advantages of the use of a two-part sley profile 1 in contrast with the prior art are evident. If desired, the tandem nozzle 8 can, as shown in FIG. 4, be arranged on the auxiliary profile part 5 in alignment and in series ahead of the main nozzle 6, which is placed on the main profile part 4, with it being possible to produce a rotationally fixed connection between the main profile part 4 and the auxiliary profile part 5. Thereby additional thread deflection points between the tandem nozzle 8 and the main nozzle 6 are avoided, since the tandem nozzle 8 is now moved synchronously in rotationally fixed connection with the main nozzle 6. If in another operating mode the tandem nozzle 8 is no longer required, it can be removed together with the entire auxiliary profile part 5; and the sley apparatus 10 operates only with a main nozzle 6, which sits on the main profile part 4. The additional mass of the auxiliary profile part 5 need no longer be co-moved.

Figure 5:
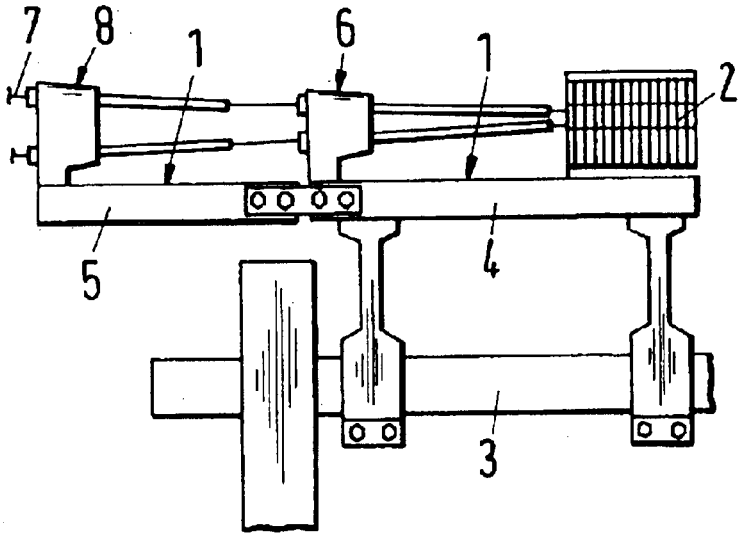
FIG. 5 shows a variant of the embodiment in accordance with FIG. 4.
Figure 6:
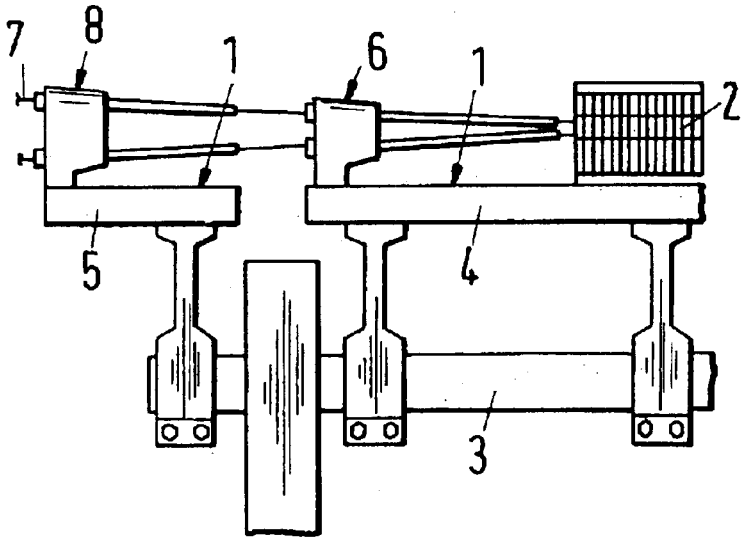
FIG. 6 shows a further variant of the embodiment in accordance with FIG. 4.

In this the auxiliary profile part 5 need not necessarily be in rotationally fixed connection with the main profile part 4 and the drive 3 at the same time. FIG. 5 shows a variant in which the auxiliary profile part 5 is in direct rotationally fixed connection only with the main profile part 4. FIG. 6 shows a further alternative, in which the auxiliary profile part 5 is rotationally fixedly connected directly to the drive 3, but only indirectly to the main profile part 4, namely via the drive 3.

Figure 8:
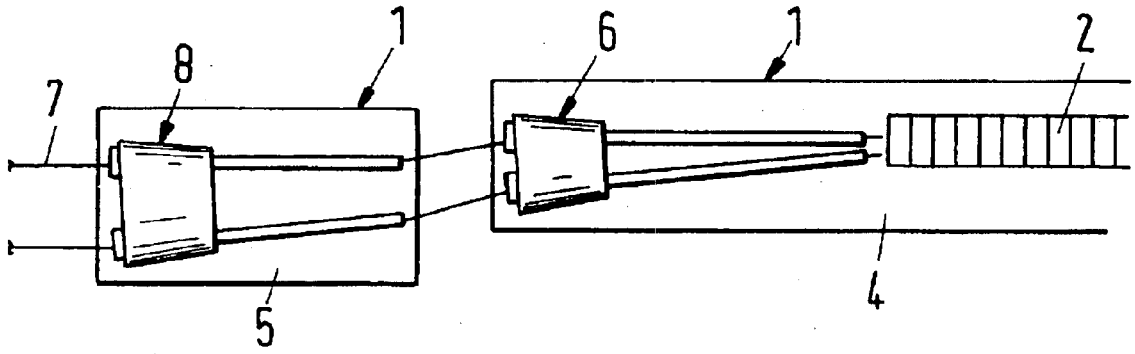
FIG. 8 shows another further variant of the embodiment in accordance with FIG. 4.

In this the tandem nozzle 8 and the main nozzle 6 need not necessarily be arranged in alignment in the weft insertion direction 1—1. Depending on the kind of the thread 7 to be processed or, for example, as a result of a special geometrical arrangement of different machine elements with respect to one another, or under special technical and technological conditions, such as special operating modes and operating states, the tandem nozzle 8 can be suitably orientated in any desired direction with respect to the main nozzle 6. FIG. 8 shows schematically the illustration of an arrangement in which the tandem nozzle 8 and the main nozzle 6 are not arranged in alignment.

Even with corresponding reduction of the cloth width, significant advantages result in contrast with the prior art. If the cloth width is correspondingly reduced, the main nozzle 6 and the tandem nozzle 8 can both be placed on the main profile part 4. In the sley apparatus in accordance with the invention the auxiliary profile part 5 can likewise be removed in such a case, so that the additional mass of the auxiliary profile part 5 need no longer be co-moved.

Figure 7:
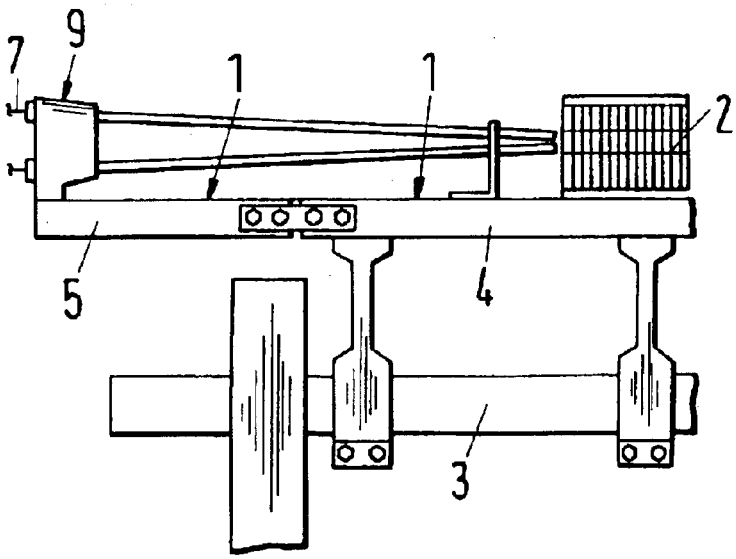
FIG. 7 shows a further embodiment of a sley apparatus in accordance with the invention with an overlong main nozzle.

If, for specific reasons, the use of a main nozzle 9 of increased length becomes necessary in the case of a non-reduced cloth width, the main profile part 4 can be extended in a simple manner in the sley apparatus in accordance with the invention, through the auxiliary profile part 5, with it being possible to connect the auxiliary profile part 5, for example, directly to the main profile part 4 as shown in FIG. 7. Naturally a rotationally fixed connection between the auxiliary profile part 5 and the main profile part 4 can also be produced in a manner different from that shown in FIG. 7.

In summary, the above description shows that the flexibility of a jet weaving machine is considerably increased in contrast with the prior art through the use of a sley apparatus in accordance with the invention, as is already shown by the few selected variants of some preferred embodiments. The problems which are unavoidable in the combination of a main nozzle with a tandem nozzle in the prior art are solved, through which technical sequences in the operation of a jet weaving machine can be further optimized and economically significantly improved production conditions can be achieved.

What is claimed is:

1. Sley apparatus for a weaving machine, having a sley profile, a reed and a drive, the sley profile carrying the reed and being in active connection with the drive, wherein the sley profile comprises at least two separate parts comprising a main profile part and an auxiliary profile part, the auxiliary profile part being releasably connected to the main profile part, a main nozzle arranged on the main profile part for the insertion of a weft thread by means of a fluid, and a tandem nozzle arranged on the auxiliary profile part for assisting the main nozzle.

2. Sley apparatus in accordance with claim 1, wherein the auxiliary profile part is rotationally fixedly and releasably connected to the main profile part.

3. Sley apparatus in accordance with claim 1, wherein the auxiliary profile part is directly connected to the drive via a rotationally fixed releasable connection.

4. Sley apparatus in accordance with claim 1, wherein the main profile part is rotationally fixedly and releasably connected directly to the auxiliary profile part.

5. An air jet weaving machine, comprising a sley apparatus for a weaving machine, having a sley profile, a reed and a drive, the sley profile carrying the reed and being in active connection with the drive, wherein the sley profile comprises at least two separate parts comprising a main profile part and an auxiliary profile part, the auxiliary profile part being releasably connected to the main profile part, a main nozzle arranged on the main profile part for the insertion of a weft thread by means of a fluid, and a tandem nozzle arranged on the auxiliary profile part for assisting the main nozzle.

6. Sley apparatus for a weaving machine, having a sley profile, a reed and a drive, the sley profile carrying the reed and being in active connection with the drive, wherein the sley profile comprises at least two separate parts comprising a main profile part and an auxiliary profile part, the auxiliary profile part being releasably connected to the main profile part and being directly connected to the drive via a rotationally fixed releasable connection.

7. Sley apparatus in accordance with claim 6, including a main nozzle arranged on the auxiliary profile part.

8. Sley apparatus in accordance with claim 6, with the main nozzle being arranged on the main profile part and the tandem nozzle being arranged on the auxiliary profile part.

9. Sley apparatus in accordance with claim 6, including a main nozzle on the sley profile for the insertion of a weft thread by means of a fluid.

10. Sley apparatus in accordance with claim 9, including a tandem nozzle on the sley profile for assisting the main nozzle.

11. Sley apparatus in accordance with claim 10, wherein the main nozzle and the tandem nozzle are arranged in series and in alignment along a weft thread insertion direction.

12. Sley apparatus in accordance with claim 10, wherein the main nozzle and the tandem nozzle are arranged in series and not in alignment along the weft thread insertion direction.

* * * * *